US005244135A

United States Patent [19]

Nelson

[11] Patent Number: 5,244,135

[45] Date of Patent: Sep. 14, 1993

[54] NECK STRAP FOR SUPPORTING AN ARTICLE

[76] Inventor: Richard G. Nelson, 186 Dusky La., Suffield, Conn. 06078

[21] Appl. No.: 805,772

[22] Filed: Dec. 12, 1991

[51] Int. Cl.[5] ..... A45F 3/02

[52] U.S. Cl. ..... 224/202; 224/257; 63/2; 63/DIG. 3; 24/3 B; 24/602

[58] Field of Search ..... 224/257, 258, 202, 205, 224/207; 63/DIG. 3, 2, 3; 24/602, 3 B, 713.1, 715.4

[56] References Cited

U.S. PATENT DOCUMENTS

| | | | |
|---|---|---|---|
| 839,047 | 12/1906 | Sylvester | 59/80 |
| 911,573 | 2/1909 | Crooks | 24/713.1 |
| 2,009,330 | 7/1935 | Tate | 24/713.1 |
| 2,481,946 | 9/1949 | Pendleton | 88/51 |
| 2,704,961 | 3/1955 | Weil | 88/51 |
| 2,967,340 | 1/1961 | Pernecky, Jr. | 224/258 |
| 3,212,679 | 10/1965 | Schmidt, Jr. | 224/235 |
| 3,225,982 | 12/1965 | Melton . | |
| 4,317,337 | 3/1982 | Walden et al. | 63/3 |
| 4,543,695 | 10/1985 | Dorsey | 24/662 |
| 4,795,069 | 1/1989 | Ferrill | 224/202 |
| 4,898,311 | 2/1990 | Boyer | 224/257 |
| 4,937,920 | 7/1990 | Tsai | 24/3 C |
| 4,993,611 | 2/1991 | Longo | 224/148 |

FOREIGN PATENT DOCUMENTS

| | | | |
|---|---|---|---|
| 660312 | 3/1963 | Canada | 63/DIG. 3 |
| 175509 | 8/1905 | Fed. Rep. of Germany | 24/715.4 |
| 1000098 | 4/1902 | France | 63/3 |
| 772982 | 5/1933 | France | 63/2 |

*Primary Examiner*—Linda J. Sholl
*Attorney, Agent, or Firm*—John E. Benoit

[57] ABSTRACT

A neck strap for supporting an article which comprises a flexible cord terminating in aglets at either end. The strap is passed through a slot in a flange at one end of the container. The aglets are inserted into opposite ends of a length of flexible hollow tubing with the outside diameter of the aglet and the inside diameter of the tubing being of dimensions such that there is a friction fit between the aglets and the tubing. The reduced force required for separation of the aglet and tubing prevents injury to the wearer.

6 Claims, 1 Drawing Sheet

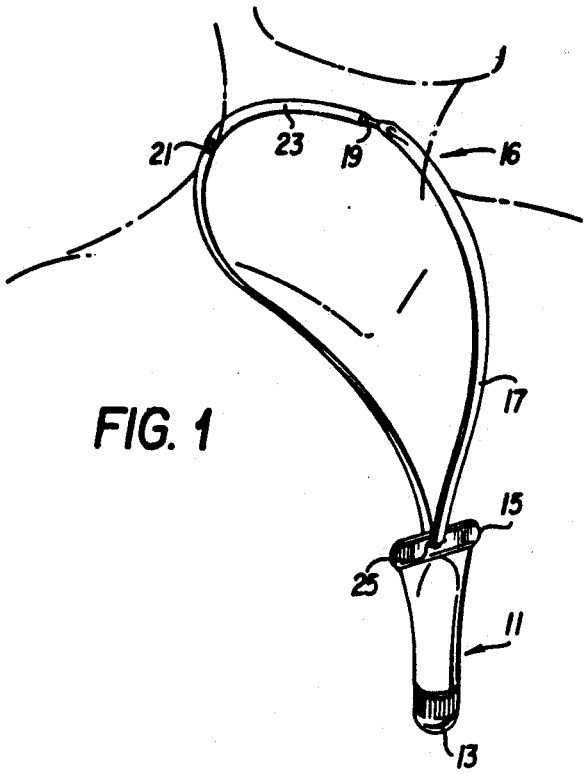
FIG. 1
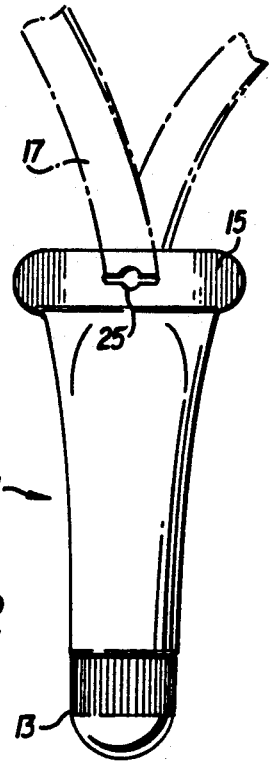
FIG. 2
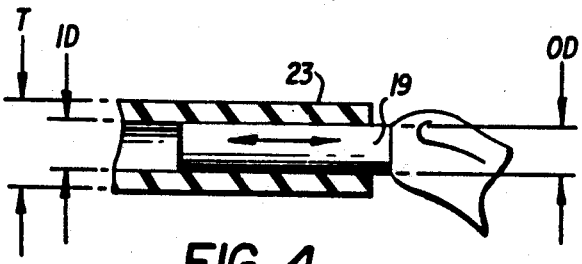
FIG. 4
FIG. 3
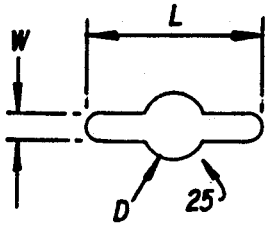
FIG. 5
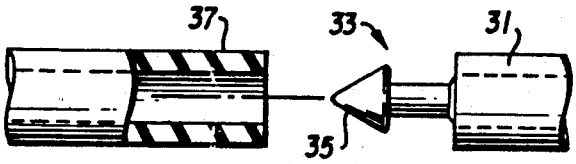

NECK STRAP FOR SUPPORTING AN ARTICLE

This application relates generally to support structures, and more particularly to a neck strap support for articles which are desired to be hung about the neck.

It is a common practice to sell articles in the toiletry field such as sunscreen and/or lip care products, creams in tubes, etc. with a neck hanger which is usually made of nylon cord strung through a cap-type device of a propel/repel lip care product. Such cords are also used for carrying whistles, identification badges, season passes, etc.

The use of such a neck strap presents a hazardous condition in that such straps have a high breakpoint, particularly when they are of the nylon/synthetic cord type. Should the cord become caught on any object while the wearer is running or walking rapidly, or if some machinery caught the strap, severe neck injury could occur.

An object of the present invention is to provide a neck strap for carrying an article about the neck which, while retaining the article under any normal force conditions, will separate with a predetermined pull weight.

It is a further object of this invention to provide a neck strap using a relatively soft tubing along the portion of the strap that usually contacts the neck, thus providing greater comfort than standard cords.

A further object of the invention is to provide a breakaway type of neck strap which may be easily reassembled for further usage.

SUMMARY OF THE INVENTION

The present invention provides a neck strap for supporting an article, wherein the strap comprises a flexible cord terminating in aglets at either end. This strap is passed through a slot in the article, usually in a flange at one end thereof. The aglets are inserted into opposite ends of a length of flexible hollow tubing with the cross-sectional area of the aglets being greater than the cross-sectional area of the inside of the tubing such that at least one of the aglets is retained within the tubing only by frictional contact. As a result, the reduced pull weight required for separating the aglet from the tubing prevents any serious injury to the user.

BRIEF DESCRIPTION OF THE DRAWINGS

FIG. 1 is a perspective view of the present invention supporting a container;

FIG. 2 is an enlarged view of the container of FIG. 1 and associated cord;

FIG. 3 discloses a preferred slot in the flange of the container;

FIG. 4 illustrates the relationship between the tubing and the aglet; and

FIG. 5 discloses a modification of the aglet of FIG. 4.

DETAILED DESCRIPTION OF THE PREFERRED EMBODIMENTS

Referring to the drawings, there is shown in FIG. 1 an outline of a human neck with the apparatus of the present invention resting about the neck.

In the illustration of the drawings, container 11, which has cap 13 and closed end flange 15, is supported by means of cord 17, which passes through slot 25 in flange 15.

Cord 17 terminates in aglets 19 and 21 at either end of the cord. As illustrated in FIG. 1, these aglets are inserted into the distal ends of hollow tubing 23.

Referring to FIGS. 2 and 3, there is shown container 11 with a preferred slot configuration 25 in flange 15. It will be obvious that cord 17 may be of substantially any cross-sectional area such as a flat strap as shown or a round cord or any other strap-type device which may be preferred. With the particular slot configuration, it can be seen that it can easily accommodate either a flat strap or a round cord. As an example, the slot of FIG. 3 has a length L of 0.375 inch, a width W of 0.045 inch, and a diameter D of 0.130 inch. The tube may be made of a low density polyethylene material with the slot being punched out of the finished flange. It is to be understood that such a flange and slot could be associated with any article which is worn about the neck.

Referring to FIG. 4, the tube and aglet are designed such that the cross-sectional area of the interior of the tube is smaller than the cross-sectional area of the aglet. In the configuration shown, wherein aglet 19 is substantially round as is the mating interior surface of tube 27, the inside diameter ID of the tube is smaller than the outside diameter OD of the aglet. Since the tube is made of a fexible and stretchable type of material such as rubber or cured polymeric material, the insertion of the aglet into the distal end of the tube causes the aglet to be retained by a frictional pressure. The degree of frictional retainment can be controlled by adjusting the relationship of the outside diameter of the aglet with the inside diameter of the tube. While the embodiment shown illustrates both of the aglets being inserted into the tube and retained frictionally, it is obvious that one of the aglets could be secured permanently to one end of the tube with the breakaway feature being provided by the other aglet.

EXAMPLE

As an illustrative example, silicone tubing is provided having an inside diameter ID of 0.109 inch and a wall thickness T of 0.030 inch. The silicone tubing has a durometer of 60 ±5, tensile strength of 100 p.s.i. minimum, an elongation of 350% minimum, tear resistance of 90 p.p.i, and a compression set of 25% maximum.

The aglets at the end of the cord are approximately 5/8 inch long and have a diameter of 0.125 inch to 0.135 inch.

When the aglet is forced into the hollow tubing, the friction retaining force is such that it requires a pull weight of less than ten pounds, normally between eight and nine pounds, with the loop in place about a configuration similar to the neck.

When a nylon cord is used in place of the hanger of the present invention, it was found that with different types of cords the breaking strength when it was looped about a configuration similar to the neck was in all cases over 115 pounds.

It will be quite obvious that 115 pounds required for the breaking strength could cause severe damage to the neck of the wearer, particularly in view of the relatively small diameter of the normally used cords.

The aglet itself can take various forms. If a larger diameter tube were used and the same type of pull force were desired, the aglet can be conformed as in FIG. 5, wherein aglet 33 has a substantially lateral shoulder 35 with the end of the aglet tapering down to a point so that when it is fitted into tube 37 the shoulder provides an extra holding strength. Again, any particular aglet design must be tested and be in conformance with a particular tubing in order to obtain the desired break-away force.

It will now be obvious that the present invention provides a highly desirable safety feature for carrying articles of any type about the neck. While a particular container is shown, it could be used with other articles such as whistles, identification cards, season passes and the like which are usually worn by personnel when they are performing their duties.

The above description and drawings are illustrative, only, since variations in the individual components could be made without departing from the invention, the scope of which is to be limited only by the following claims.

I claim:

1. Apparatus for wearing about the neck comprising a container having an access end and a sealed end, said sealed end having a flange;

an orifice in said flange;

a flexible cord of a predetermined length passing through said orifice;

aglets permanently secured at the ends of said cord, said aglets having a predetermined cross-sectional area;

a flexible hollow tubular member having an internal cross-sectional area less than the cross-sectional area of said aglets; and means for connecting the ends of said aglets to opposite ends of said tubular member, at least one of said aglets having a friction fit within said tube whereby a predetermined pull weight separates said one of said aglets from said tubular member.

2. The apparatus of claim 1 wherein said pull weight is no more than 10 pounds.

3. The apparatus of claim 1 wherein said aglet has a substantially lateral shoulder with the end of the aglet tapering downwardly to a point.

4. The apparatus of claim 1 wherein said tubular member comprises a cured polymeric material.

5. The apparatus of claim 4 wherein said polymeric material is silicone.

6. The apparatus of claim 1 wherein said material is rubber.

* * * * *